US006250030B1

(12) United States Patent
Sugimoto et al.

(10) Patent No.: US 6,250,030 B1
(45) Date of Patent: Jun. 26, 2001

(54) PRESTRESSED CONCRETE STRUCTURE, REINFORCING MEMBER USED FOR THE PRESTRESSED CONCRETE MOLDED ARTICLES, AND SHEET MEMBER USED FOR THE REINFORCING MEMBER

(75) Inventors: Morihiko Sugimoto; Youji Yanagi, both of Ibaraki; Akira Kidera, Tokyo, all of (JP)

(73) Assignees: Teijin Limited, Osaka; Japan Prestressed Concrete Constructors Association, Tokyo, both of (JP)

( * ) Notice: Subject to any disclaimer, the term of this patent is extended or adjusted under 35 U.S.C. 154(b) by 0 days.

(21) Appl. No.: 09/355,650

(22) PCT Filed: Aug. 28, 1998

(86) PCT No.: PCT/JP98/03861

§ 371 Date: Nov. 1, 1999

§ 102(e) Date: Nov. 1, 1999

(87) PCT Pub. No.: WO99/29974

PCT Pub. Date: Jun. 17, 1999

(30) Foreign Application Priority Data

Dec. 2, 1997 (JP) ..... 9-350198
Apr. 23, 1998 (JP) ..... 10-113655

(51) Int. Cl.[7] ..... E04C 5/08
(52) U.S. Cl. ..... 52/223.1
(58) Field of Search ..... 52/223.1, 223.8, 52/223.9, 223.13, 396.04, 340, 222, 703, 716.1, 717.03, 717.04, 223.7, 737.4, 738.1; 442/209, 215, 216, 279, 168

(56) References Cited

U.S. PATENT DOCUMENTS 4,556,602 * 12/1985 Williams ..... 428/259
4,670,326 * 6/1987 Heiman ..... 428/225
5,538,781 * 7/1996 Rao ..... 428/229
6,050,038 * 4/2000 Fey ..... 52/223.7

FOREIGN PATENT DOCUMENTS 9-67943 3/1997 (JP) .
9-195445 7/1997 (JP) .
09235827 * 9/1997 (JP) .

* cited by examiner

*Primary Examiner*—Christopher T. Kent
*Assistant Examiner*—Kevin McDermott
(74) *Attorney, Agent, or Firm*—Sughrue, Mion, Zinn, Macpeak & Seas, PLLC

(57) ABSTRACT

A prestressed concrete structure comprising an elongated concrete molded article having a pair of side surfaces opposed to each other, a plurality of tensile members laterally extending through the concrete molded article to be secured at each end to the side surfaces of the concrete molded article in a tensioned state and imparting a compressive load to the concrete molded article, side guards arranged along both side surfaces of the concrete molded article so as to cover the ends of the tensile members, and reinforcing members arranged on the side surfaces of the side guards in order to prevent the broken tensile members from protruding beyond the side surfaces thereof breaking through the side guards when the tensile members in the tensioned state are broken. The reinforcing members stretch little in the longitudinal direction but easily stretch in the transverse direction on the side surfaces of the side guards, and when pushed from the inside by the ends of the tensile members that protrude as a result of breakage, the peeling of the reinforcing members spreads out in the longitudinal direction of the concrete molded article on the side surfaces of the side guards but spreads out little in the transverse direction.

50 Claims, 3 Drawing Sheets

PRESTRESSED CONCRETE STRUCTURE, REINFORCING MEMBER USED FOR THE PRESTRESSED CONCRETE MOLDED ARTICLES, AND SHEET MEMBER USED FOR THE REINFORCING MEMBER

This application is a continuation of PCT application No. PCT/JP98/03861 filed on Aug. 28, 1998.

BACKGROUND OF THE INVENTION

1. Field of the Invention

The present invention relates to a prestressed concrete structure. More specifically, the invention relates to a prestressed concrete structure which, when PC steel members tightening a concrete molded article or tightening a plurality of concrete molded articles are broken, prevents the broken PC steel members from protruding or projecting outward beyond the side portions of the prestressed concrete structure.

2. Description of the Related Art

Prestressed concrete has heretofore been widely known. Prestressed concrete is a technology for enhancing the tensile load characteristics of the concrete by imparting a compressive load prior to the use, and is generally used for large concrete structures such as bridge structures. The compressive load can be imparted to the prestressed concrete in various ways. In a large concrete structure, the compressive load is often imparted relying on a pre-tension method, a post-tension method or a combination of the pre-tension method and the post-tension method.

In a large concrete structure and, particularly, the one adapted to the bridge structures, a plurality of tension members constituted by PC steel rods or PC steel wires that extend in a horizontally transverse direction perpendicular to the longitudinal direction of the bridges, are arranged in parallel in the horizontally longitudinal direction, so that a plurality of neighboring concrete molded articles are fastened together by these tension members, and a large tension is given to the tension members to tighten the concrete molded articles, in order to impart compressive load in the transverse direction to each of the concrete molded articles. In the thus formed concrete structure, in case a tension member to which a large tensile force is imparted breaks due to some cause, the broken tensile member protrudes or projects outward beyond the side portion of the concrete structure.

In order to solve this problem according to, for example, Japanese Patent No. 2742675, a reinforcing sheet of carbon fibers, aramid fibers or a combination thereof is adhered onto the axes of the PC steel members on the side surface of the prestressed concrete structure. In this reinforcing sheet, the warps and wefts are composed of fibers of the same material. When hit by the broken PC steel member, therefore, the reinforcing sheet peels roughly uniformly off the side surface of the prestressed concrete structure. When the reinforcing sheet is peeled up to the edges of the prestressed concrete structure, therefore, there results a conspicuous decrease in the adhesion strength of the reinforcing sheet on the side surface of the prestressed concrete structure. As described above, the reinforcing sheet is roughly uniformly peeled off the side surface of the prestressed concrete structure. When the prestressed concrete structure is a long one such as a bridge structure and has a side surface of an elongated shape, i.e., when the aspect ratio is relatively great, the peeling, which proceeds in a direction in parallel with the short side, quickly arrives at the edge of the prestressed concrete structure resulting in a remarkable drop in the adhesion strength of the reinforcing sheet.

The present invention was accomplished in order to solve this problem, and its object is to provide a prestressed concrete structure which, when the PC steel members used in the prestressed concrete structure are broken, prevents the broken PC steel members from protruding or projecting outward beyond the side portions of the prestressed concrete structure.

Another object of the present invention is to provide a fiber-reinforced resin composite material used for preventing the broken PC steel members from protruding or projecting outward beyond the side portions of the prestressed concrete structure.

A further object of the present invention is to provide a sheet member used for preventing the broken PC steel materials from protruding or projecting outward beyond the side portions of the prestressed concrete structure.

SUMMARY OF THE INVENTION

According to the present invention, there is provided a prestressed concrete structure comprising:

a long concrete molded article having a pair of side surfaces opposed to each other;

a plurality of tensile members penetrating and stretching inside the concrete molded article from one of the pair of the surfaces toward the other the surface in a transverse direction, secured at their both ends to the the surfaces of the concrete molded article in a tensioned state, and are imparting a compressive load to the concrete molded article;

a pair of side guards arranged along both side surfaces of the concrete molded article so as to cover the ends of the tensile members; and reinforcing members arranged on the side surfaces of the pair of the guards in order to prevent the broken tensile members from protruding beyond the side surfaces thereof breaking through the side guards when the tensile members in the tensioned state are broken; wherein the reinforcing members stretch little in the longitudinal direction of the side surfaces of the side guards but easily stretch in the transverse direction on the the surfaces of the side guards and, when pushed from the inside by the ends of the tensile members that protrude as a result of breakage, the peeling of the reinforcing members easily spreads out in the longitudinal direction of the side surfaces of the side guards but spreads out little in the transverse direction on the the surfaces of the side guides.

The tensile member that is broken no longer imparts a tensile force. Therefore, a large thrust acts upon the broken tensile member in the axial direction thereof. Due to the thrust, the broken tensile member moves in the axial direction. The magnitude of thrust acting on the tensile member at breakage varies depending upon the conditions such as the length of the tensile member that is broken, magnitude of tension acting on the tensile member at breakage, rate of progress leading to breakage, material of the tensile member, and the like. When the tensile member is a PC steel rod, in particular, it has been known that a large thrust acts. When the thrust is great, the broken tensile members often protrude beyond the side surfaces of the side guards.

According to the present invention, the tensile members that protrude penetrating through the side guard come into collision with the reinforcing member provided on the side surface of the side guard. The reinforcing member is peeled off the side surface of the side guard while being stretched, thereby to effectively absorb the kinetic energy of the tensile members that are broken.

In general, as the peeling of the reinforcing member spreads out and reaches the upper and lower edges on the side surface of the side guard, the bonding force of the reinforcing member on the side surface of the side guard greatly drops at that portion resulting in a sharp decrease in the ability for absorbing the kinetic energy of the tensile members that are broken. According to the present invention, the reinforcing member stretches little in the longitudinal direction but easily stretches in the transverse direction on the side surface of the side guard. Therefore, peeling of the reinforcing member spreads out in the longitudinal direction on the surface of the side guard but hardly spreads out in the transverse direction to alleviate the above-mentioned problem.

Preferably, furthermore, the reinforcing member includes warps that extend in the longitudinal direction on the side surfaces of said side guards, wefts that extend in the transverse direction, and a resin material for bonding said warps and said wefts, said warps having a tensile modulus of from 5000 to 18000 kgf/mm$^2$ and said wefts having a tensile modulus of from 300 to 4500 kgf/mm$^2$.

The warps having a large tensile modulus stretch little. Therefore, the reinforcing members stretch little in the longitudinal direction on the side surfaces of the side guards and are easily peeled off the side surfaces of the side guards. Upon decreasing the tensile modulus of the wefts, the reinforcing member is allowed to easily stretch in the transverse direction on the side surfaces of the side guards and are hardly peeled off.

A further feature of the present invention is to provide a fiber-reinforced resin composite material comprising a woven fabric of aramid fibers and non-aramid fibers, and a resin for bonding said woven fabric, said woven fabric having a tensile modulus of from 3000 to 15000 kgf/mm$^2$ in the direction of aramid fibers and a tensile modulus of from 150 to 3000 kgf/mm$^2$ in the direction of non-aramid fibers.

A still further feature of the present invention is to provide a sheet member containing a woven fabric of aramid fibers and non-aramid fibers, said woven fabric having a tensile modulus of from 3000 to 15000 kgf/mm$^2$ in the direction of aramid fibers and a tensile modulus of from 150 to 3000 kgf/mm$^2$ in the direction of non-aramid fibers.

DESCRIPTION OF THE PREFERRED EMBODIMENTS

An embodiment of the present invention will now be described with reference to the accompanying drawings dealing with a prestressed concrete bridge structure. The prestressed concrete bridge structure is formed by bonding and fastening a plurality of concrete molded articles arranged neighboring one another by using tensile members (hereinafter simply referred to as PC steel members) constituted by a plurality of PC steel rods or PC steel wires.

Figure 3:
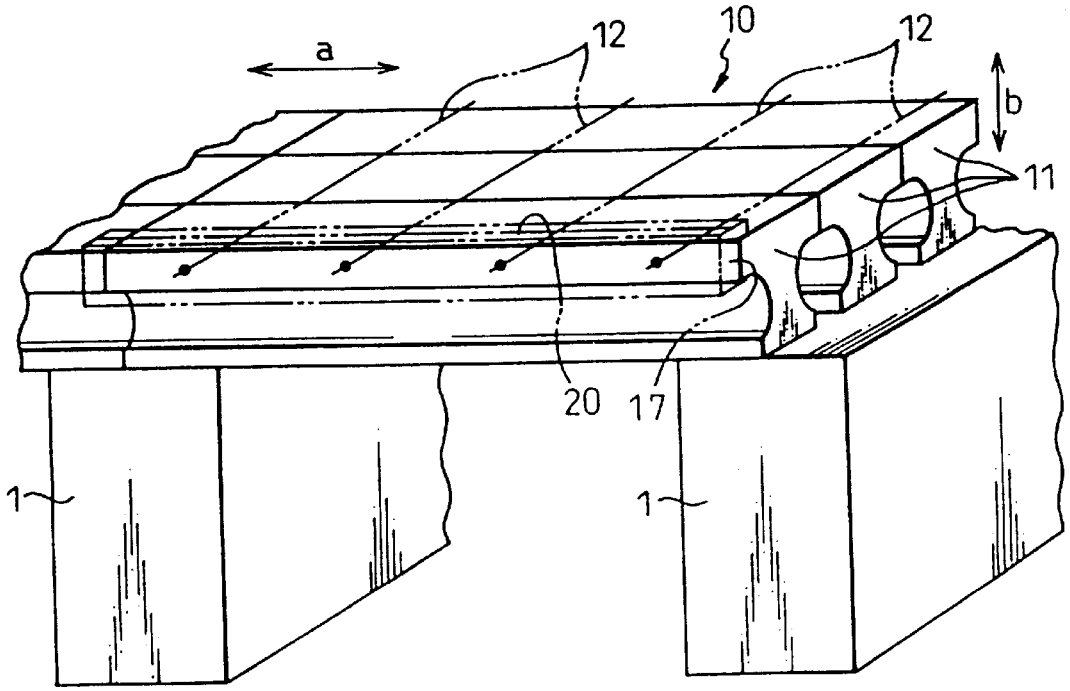
FIG. 3 is a perspective view of the prestressed concrete structure on the bridge piers.

Referring to FIG. 3, a large prestressed concrete structure 10 is installed on a plurality of bridge piers 1 erected maintaining a predetermined distance in the longitudinal direction indicated by an arrow "a". The prestressed concrete structure 10 comprises a plurality of long concrete molded articles 11 having a nearly T-shape in cross section, the concrete molded articles 11 being coupled and tightened together by a plurality of PC steel members 12 that are arranged to extend in the horizontally transverse direction. In FIG. 3, the PC steel members 12 are arranged in one layer in the horizontal direction but may be arranged in a plurality of layers of two or more layers, as a matter of course.

Figure 1:
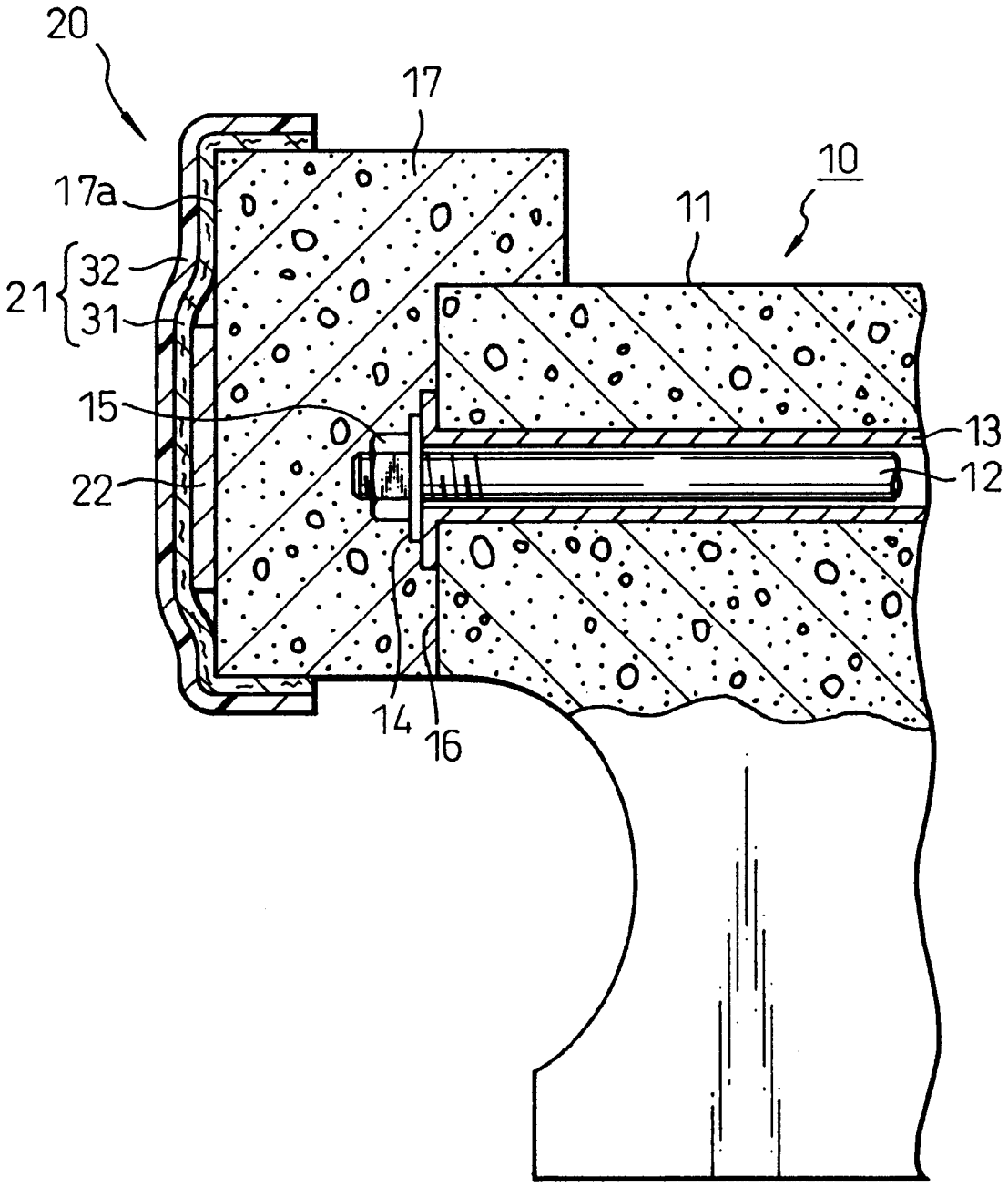
FIG. 1 is a sectional view illustrating, on an enlarged scale, a major portion of a prestressed concrete structure according to the present invention.

Referring to FIG. 1, each concrete molded article 11 has a hollow tube or a sleeve 13 that penetrates through and extends in the transverse direction. The sleeve 13 can be arranged in advance in a molding flask (not shown) before the molding flask is filled with a concrete. The PC steel member 12 is passed through the sleeve 13 and is then tightened by using a tension-imparting device such as a jack. Nuts 15 screwed onto both ends of the PC steel member 12 are tightened, and both ends of the PC steel member 12 are fixed to the side surfaces 16 of the concrete molded article 11 located on the outermost sides via a washer 14. A compressive load is imparted to the concrete molded article 11 due to the tension acting on the PC steel member 12. A gap between the PC steel member 12 and the sleeve 13 may be filled with a mortar or a paste to prevent the corrosion of the PC steel member 12.

The ends of the PC steel member 12 protrude beyond both side surfaces of the prestressed concrete structure 10, i.e., protrude beyond the side surfaces 16 of the concrete molded articles located on the outermost sides among a plurality of concrete molded articles arranged in parallel. Besides, as shown in FIG. 1, ground covers or side guides 17 made of a concrete or a mortar and having an L-shape in cross section, have heretofore been provided for the outer side surfaces 16. The side guards 17 prevent the vehicles from falling off the bridge and further prevent the PC steel member from protruding or projecting beyond the side portions of the prestressed concrete structure 10 in case the PC steel member 12 on which the tension is exerted is broken. According to the constitution of the prior art, however, the PC steel member 12 that is broken may project outward breaking through the side guard 17 depending upon the conditions at the time of breakage. To completely prevent the broken PC steel member from breaking through the side guard 17, it becomes necessary to form very strong side guards 17 which are large in size, driving up the cost of construction.

In a preferred embodiment of the present invention as shown in FIGS. 1 and 3, a reinforcing member 20 is stuck, using an adhesive agent, to the side surface 17*a* of the side guard 17 to reinforce the side surface 17*a* of the side guard 17 with the reinforcing member 20. The reinforcing member 20 includes a covering member 21 and a backing member 22. The backing member 22 is provided between the covering member 21 and the side surface 17*a* of the side guard 17, and is arranged on a straight line relative to the PC steel member 12. As shown in FIG. 3, the reinforcing member 20 may have roughly the same length as the overall length of the side guard 17 in the longitudinal direction but may be divided to facilitate the transportation and the mounting operation.

Desirably, the backing member 22 has a side surface smaller than the area of the side surface 17*a* of the side guard 17. When the area of the backing member 22 is nearly equal to the area of the side surface 17*a* of the side guard 17, the reinforcing member 20 is little stretched and deformed when the PC steel member that is broken comes into collision with the backing member 22, and the covering member 21 is easily peeled off the side guard 17. When the area of the backing member 22 is very much smaller than the area of the covering member 21, stress is concentrated in the reinforcing member 20 when the PC steel member comes into collision with the backing member 22, and the PC steel member may easily protrude by breaking through the reinforcing member 20. Desirably, the area of the backing member 22 is one-tenth to one-half the area of the side surface 17*a* of the side guard 17.

Referring to FIG. 1, the covering member 21 is formed of a fiber-reinforced resin composite material (FRP) obtained by bonding a reinforcing fiber material 31 with a resin layer 32. The reinforcing fiber material 31 may be formed of a sheet member of a single layer or a plurality of layers of a woven fabric. The woven fabric includes warps 41 of yarns containing aramid fibers and extending in the longitudinal direction of the side surface 17*a* of the side guard 17 indicated by an arrow "a" in FIG. 2, and wefts 42 of yarns containing non-aramid fibers and extending in the transverse direction of the side surface 17*a* of the side guard 17 indicated by an arrow "b" in FIG. 2. Hereinafter, the transverse direction is a vertical direction with respect to the longitudinal direction of the side surface 17*a* of the side guard 17.

The material of the resin layer 32 for bonding the reinforcing fiber material 31 is desirably selected from the group consisting of an epoxy resin, an urethane resin, an acrylic resin and an ester resin. The most desired material is the epoxy resin.

The wefts 42 have a tensile modulus smaller than that of the warps. Therefore, the wefts easily stretch compared with the warps 41. If the broken PC steel member 12 protrudes by breaking through the side guard 17 and collides with the backing member 22, the covering member 21 is pushed from the inside. The covering member 21 stretches little in the direction of arrow "a" in FIG. 3, i.e., stretches little in the longitudinal direction of the concrete molded article 11 or of the side guard 17, but stretches in the vertical direction "b". Therefore, the peeling of the reinforcing member 20 from the side surface 17*a* of the side guard 17 spreads out in the longitudinal direction a but hardly spreads out in the vertical direction "b" perpendicular thereto. Therefore, the region of the reinforcing member 20 peeled off the side surface 17*a* of the side guard 17 describes a generally elliptic shape having a long diameter in the longitudinal direction of the side surface 17*a* of the side guard 17.

On the other hand, when a material having a large tensile modulus is used for the warps and the wefts, the peeling spreads out similarly in the longitudinal direction a and in the vertical direction "b". When the peeling of the reinforcing member 20 reaches the upper and lower edges of the side surface of the side guard 17, the bonding force of the reinforcing member 20 to the side surface 17*a* of the side guard 17 conspicuously decreases at that portion and becomes no longer capable of absorbing the kinetic energy of the broken PC steel member that protrudes. According to the embodiment of the invention, the reinforcing member 20 easily spreads out in the longitudinal direction "a" but hardly spreads out in the vertical direction "b" i.e., the reinforcing member 20 peels off describing an elliptical shape having a long diameter in the longitudinal direction "a" in order to alleviate the above-mentioned problem. Accordingly, the reinforcing member 20 becomes capable of absorbing larger kinetic energy of the broken PC steel member.

As a material having such properties, the warps 41 may comprise the yarns containing 100% by weight of aramid fibers or may comprise blended yarns containing not less than 50% by weight of aramid fibers. Or, the warps 41 may comprise the yarns of aramid fibers and the yarns of other materials arranged alternatingly. The wefts 42 may comprise the yarns containing non-aramid fibers of an organic material. If described in detail, the non-aramid fibers can be selected from the group consisting of polyester fibers, vinylon fibers and polyamide fibers. Most desirably, the nylon fibers are used.

Figure 2:
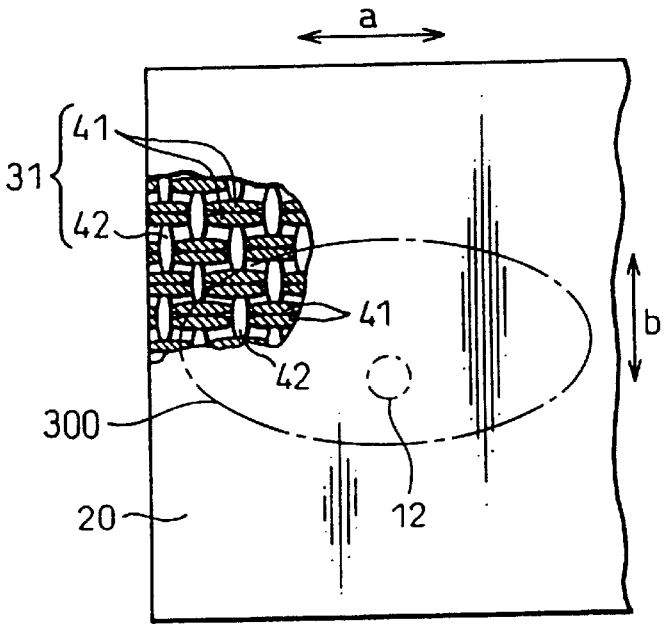
FIG. 2 is a front view illustrating, partly in cross section, a reinforcing member.

The reinforcing fiber material 31 is not limited to the biaxially woven fabric shown in FIG. 2 but may be a multi-axially woven fabric of three or more axes.

Desirably, furthermore, the reinforcing fiber material 31 has the following properties A and B of the woven fabric:

Property A: tensile modulus is from 150 to 15000 kgf/mm$^2$,

Property B: tensile toughness is from 400 to 4000 kgf %/mm$^2$.

It is further desired to possess the property C.

Property C: tensile strength is from 50 to 350 kgf/mm$^2$.

The above-mentioned properties are the values per a sectional area of the fibers in the fiber-reinforced resin composite material, and the tensile toughness is a product of the stress and the elongation at breakage, and the tensile strength is a stress at breakage. Described below are the conditions of the tensile testing machine for measuring the tensile modulus, tensile strength and elongation.

a) Transverse direction of the test piece (direction of warps):

Width of test piece: 12.5 mm

Kind of chuck: wedge

Distance of gripping: 100 mm

Method of detecting the elongation: strain gauge

Tension speed: 2 mm/min.

How to find the tensile modulus: Gradient of a straight line over a range of 40 to 60% of stress at breakage on a stress—elongation curve.

b) Longitudinal direction the test piece (direction of wefts):

Width of test piece: 12.5 mm

Kind of chuck: wedge

Distance of gripping: 100 mm

Method of detecting the elongation: tension tester

Tension speed: 50 mm/min.

How to find the tensile modulus: Gradient of a straight line over a range of 40 to 60% of stress at breakage on a stress—elongation curve.

The above-mentioned woven fabric has a desired tensile modulus over a range of from 150 to 15000 kgf/mm$^2$ and, more preferably, over a range of from 200 to 10000 kgf/mm$^2$. When the tensile modulus is smaller than 150 kgf/mm$^2$, a local elongation becomes conspicuous, and the fiber-reinforced resin composite material is broken through due to the concentration of stress. When the tensile modulus exceeds 15000 kgf/mm$^2$, on the other hand, the kinetic energy of the PC steel member that is broken is not absorbed, and the fiber-reinforced resin composite material easily peels off the side surface of the side guard. If described in further detail, the woven fabric desirably has a tensile modulus of from 3000 to 15000 kgf/mm$^2$ in the direction of warps and has a tensile modulus of from 150 to 3000 kgf/mm$^2$ in the direction of wefts.

The woven fabric has a desired tensile toughness over a range of from 400 to 4000 kgf %/mm$^2$ and, more preferably, over a range of from 750 to 3500 kgf %/mm. When the tensile toughness is smaller than 400 kgf %/mm$^2$, the kinetic energy is not absorbed, and the fiber-reinforced resin composite material is broken through by the PC steel member that is broken. When the tensile toughness exceeds 4000 kgf %/mm$^2$, on the other hand, the material fails to exhibit the tensile modulus over the above-mentioned desired range, and the kinetic energy is not absorbed. If described in further detail, the woven fabric has a tensile toughness of from 500 to 2000 kgf %/mm$^2$ in the direction of warps and has a tensile toughness of from 400 to 4000 kgf %/mm$^2$ in the direction of wefts.

The woven fabric has a desirable tensile strength over a range of from 50 to 350 kgf/mm$^2$ and, more preferably, over a range of from 70 to 300 kgf/mm$^2$. When the tensile strength is smaller than 50 kgf/mm$^2$, the kinetic energy is hardly absorbed, and the fiber-reinforced resin composite material is broken through by the PC steel member that is broken. When the tensile strength exceeds 350 kgf/mm$^2$, on the other hand, the material fails to exhibit the tensile modulus over the above-mentioned desired range. Therefore, the kinetic energy is not absorbed, and the fiber-reinforced resin composite material easily peels off the side surface of the side guard. If further described in detail, the woven fabric has a tensile strength of from 200 to 350 kgf/mm$^2$ in the direction of warps and a tensile strength of from 50 to 150 kgf/mm$^2$ in the direction of wefts.

Figure 4:
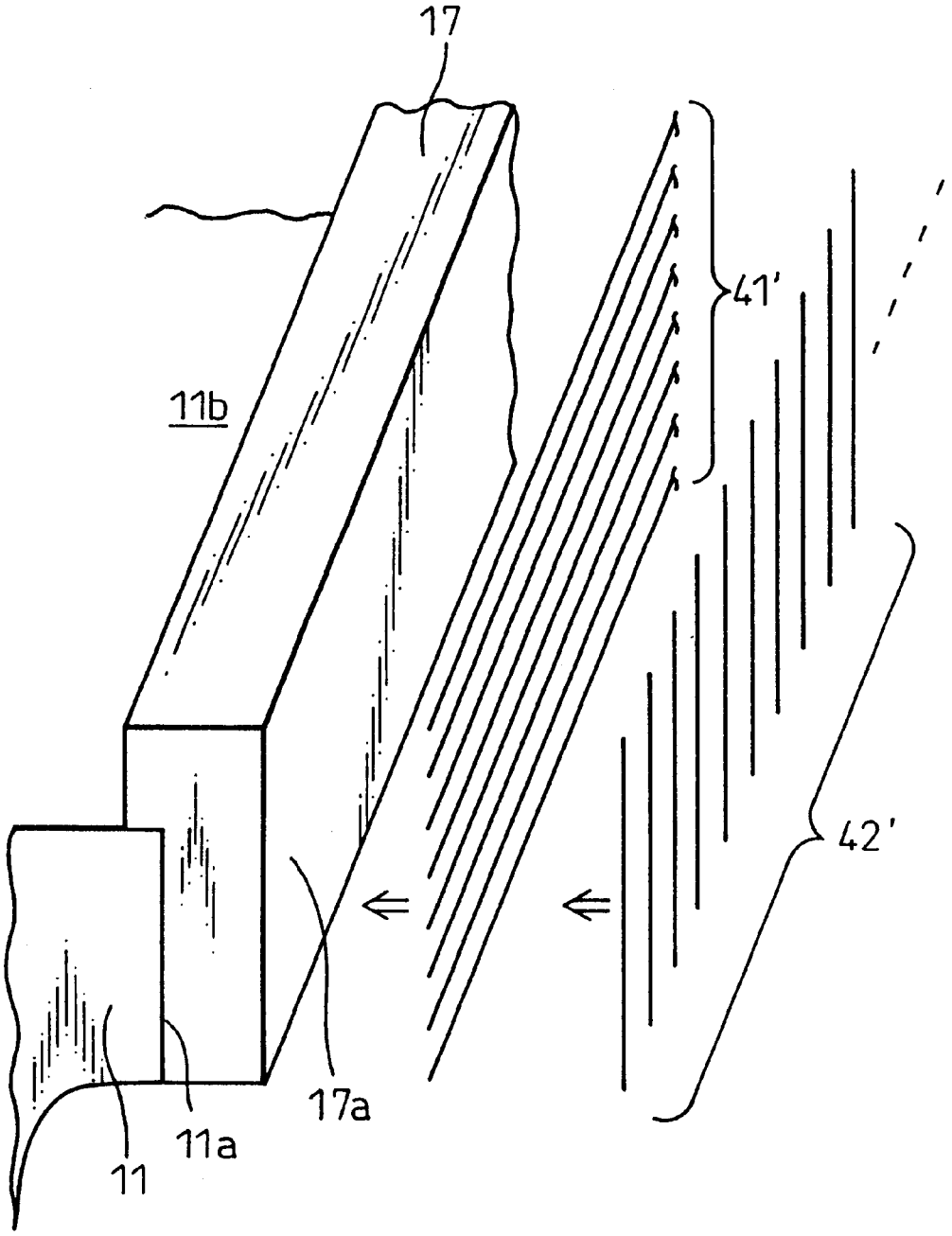
FIG. 4 is a perspective view of a side portion of the prestressed concrete structure for illustrating another embodiment of the reinforcing member.

The reinforcing fiber material 31 may not be the woven fabric shown in FIG. 2 but may be the one obtained, as shown in FIG. 4, by separately sticking the warps 41' and the wefts 42' on the side surface 17*a* of the side guard 17 in the longitudinal direction and in the vertical direction being bonded with a resin material. Desirably, the warp 41' has a tensile strength of from 250 to 400 kgf/mm$^2$, a tensile modulus of from 5000 to 18000 kgf/mm$^2$, an elongation at breakage of from 2 to 6%, and a tensile toughness of from 500 to 2200 kgf %/mm$^2$. Desirably, the weft 42' has a tensile strength of from 60 to 250 kgf/mm$^2$, a tensile modulus of from 300 to 4500 kgf/mm$^2$, an elongation at breakage of from 3 to 30% and a tensile toughness of from 300 to 3000 kgf %/mm$^2$.

As a material having such properties, the warps 41' may comprise the yarns containing 100% by weight of aramid fibers or may comprise blended yarns containing not less than 50% by weight of aramid fibers like that of the embodiment of FIG. 2. The wefts 42' may comprise the yarns containing non-aramid fibers of an organic material. If described in detail, the non-aramid fibers can be selected from the group consisting of polyester fibers, vinylon fibers and polyamide fibers. Most desirably, the nylon fibers are used.

In the foregoing description, the "transverse direction" is the one perpendicular to the longitudinal direction of the side surface of the side guard 17. Not being limited thereto only, however, the "transverse direction" according to the present invention may include a biasing direction deviated from the true vertical direction.

Furthermore, the backing member 22 may be the one formed of a fiber-reinforced resin composite material like the covering member 21, or may be a metal plate such as a steel plate in its place. when the backing member is formed of the fiber-reinforced resin composite material, its tensile toughness may be smaller than that of the covering member 21.

In FIG. 1, the reinforcing member 20 has a U-shape in transverse cross section. Not being limited to this shape only, however, the reinforcing member 20 may have any shape provided it is capable of dispersing the stress that is concentrated when the PC steel member 12 collides therewith by breaking through the side guard 17.

Next, described below is the action of the reinforcing member.

The PC steel member 12 that is broken breaks through the side guard 17 made of a concrete or a mortar, comes into collision with the backing member 22 of the reinforcing member 20 peeling the backing member 22 off the side surface 17*a* of the side guard 17 and stretching and deforming the covering member 21. At this moment, the backing member 22 absorbs the kinetic energy of the PC steel member 12 as it peels off the side surface 17*a* of the side guard 17.

The warps 41 of aramid fibers have a relatively large tensile modulus and absorb the kinetic energy of the broken PC steel member 12 as it is peeled off the side surface 17*a* of the side guard 17. On the other hand, the wefts 42 have a tensile modulus smaller than that of the warps 41 and undergo stretching without being peeled off so much and, hence, absorb the kinetic energy of the PC steel member 12.

As described above, the reinforcing member 20 has energy-absorbing mechanisms that work in quite different ways in the two different directions. As a result of compounding these mechanisms, the reinforcing member 20 is peeled off the side surface 17*a* of the side guard 17 in a flat elliptic shape 300, as shown in FIG. 2 having a long diameter in the longitudinal direction of the side surface 17*a* . Therefore, the reinforcing member 20 is not entirely peeled off, the PC steel member 12 does not protrude by breaking through the reinforcing member 20, and the PC steel member 12 that is broken is effectively prevented from protruding.

The reinforcing member 20 may be obtained in the form of a fiber-reinforced resin composite material by curing the woven fabric with a resin and may then be stuck with an adhesive agent or the woven fabric may be coated and impregnated with the resin, and may then be stuck simultaneously with the adhesion of the fiber-reinforced resin composite material.

The foregoing description has dealt with the case of a large prestressed concrete structure formed by fastening and tightening a plurality of concrete molded articles by using a plurality of PC steel members that extend in the transverse direction penetrating therethrough. However, the same actions and effects are also obtained even when a prestressed concrete structure is formed by using a single concrete molded article relying on the post tension method. In this case, the side guards are provided on both side surfaces of the single concrete molded article as a matter of course.

The reinforcing member 20 may be constituted by the covering member 21 and the backing member 22 as described above, but may also be constituted by the covering member 21 only. In this case, it is recommended to use the materials having different tensile toughnesses in the longitudinal direction and in the transverse direction or in the biasing direction.

EXAMPLE 1

A steel backing member (100 mm wide, 1600 mm long, 3.2 mm thick) was provided on the inside of a covering member of a fiber-reinforced resin composite material obtained by overlapping three pieces of woven fabrics bonded with a resin, and was bonded thereto with an epoxy resin, and was adhered onto the side surface of the side guard as shown in FIG. 1.

The woven fabrics forming the reinforcing fiber material contain Technology (trade name) fibers as aramid fibers for constituting the warps (direction "a") as well as nylon 6,6 fibers as non-aramid fibers for constituting the wefts (direction "b").

In the prestressed concrete structure of the constitution shown in FIG. 1, the PC steel rod having a diameter of 32 mm and an overall length of 10 meters was artificially broken. The PC steel rod that was broken was prevented from protruding owing to the above-mentioned reinforcing member.

Table 1 shows properties of the fiber-reinforced resin composite material.

TABLE 1

| | In the direction of Technoloa fibers | In the direction of nylon 6,6 fibers |
|---|---|---|
| Tensile strength | 244 kgf/mm$^2$ | 84 kgf/mm$^2$ |
| Tensile elongation | 3.2% | 36.6% |
| Tensile modulus | 6900 kgf/mm$^2$ | 280 kgf/mm$^2$ |
| Tensile toughness | 781 kgf %/mm$^2$ | 3074 kgf %/mm$^2$ |

Furthermore, the reinforcing fiber material and the starting yarns were constituted as described below.

Constitution of the reinforcing fiber material:

a) weaving texture: 2×1 mat weaving b) weaving density:
Longitudinal: 38 yarns/2.54 cm
Transverse: 15 yarns/2.54 cm c) Yarns:
Warps (Technola): 1500 de/1000 fil
Twisting: no twisting
Wefts (nylon 6,6): 1890 de/306 fil
Twisting: 60 T/M Constitution of the starting yarns;

a) Technola:
Denier: 1500 de
Number of filaments: 1000 fil
Strength: 28 g/de
Elongation: 4.6%
Tensile modulus of elasticity: 590 g/de
Specific gravity: 1.39 b) Nylon 6,6:
Denier: 1,890 de
Number of filaments: 306 fil
Strength: 10.3 g/de
Elongation: 21.7%
Tensile modulus of elasticity: 50g/de
Specific gravity: 1.14

EXAMPLE 2

The reinforcing member was formed of a fiber-reinforced resin composite material containing two pieces of reinforcing fiber materials but without using the steel backing member on the inside. In this case, too, the PC steel rod could be prevented from protruding. Here, the PC steel rod was 32 mm in diameter and 6 meters long. Properties of the fiber-reinforced resin composite material and constitutions of the reinforcing fiber materials and starting yarns, were the same as those of the case of Example 1.

EXAMPLE 3

A steel backing member (100 mm wide, 1600 mm long, 3.2 mm thick) was provided on the inside of a covering member of a fiber-reinforced resin composite material obtained by overlapping three pieces of woven fabrics bonded with a resin, and was bonded thereto with an epoxy resin, and was adhered onto the side surface of the side guard as shown in FIG. 1.

The woven fabrics forming the reinforcing fiber material contain Kevlar 49 (trade name) as aramid fibers for constituting the warps (direction "a") as well as nylon 6,6 fibers as non-aramid fibers for constituting the wefts (direction "b").

In the prestressed concrete structure of the constitution shown in FIG. 1, the PC steel rod having a diameter of 32 mm and an overall length of 10 meters was artificially broken. The PC steel rod that was broken was prevented from protruding owing to the above-mentioned reinforcing member.

Table 2 shows properties of the fiber-reinforced resin composite material.

TABLE 2

| | In the direction of Kevlar 49 | In the direction of nylon 6,6 fibers |
|---|---|---|
| Tensile strength | 220 kgf/mm$^2$ | 84 kgf/mm$^2$ |
| Tensile elongation | 2.4% | 36.6% |
| Tensile modulus | 6900 kgf/mm$^2$ | 280 kgf/mm$^2$ |
| Tensile toughness | 528 kgf %/mm$^2$ | 3074 kgf %/mm$^2$ |

Furthermore, the reinforcing fiber material and the starting yarns were constituted as described below.

Constitution of the reinforcing fiber material:

a) Weaving texture: 2×1 mat weaving b) Weaving density:
Longitudinal: 38 yarns/2.54 cm
Transverse: 15 yarns/2.54 cm c) Yarns:
Warps (Kevlar 49): 1450 de/1000 fil
Twisting: no twisting
Wefts (nylon 6,6): 1890 de/306 fil
Twisting: 60 T/M Constitution of the starting yarns;

a) Kevlar 49:
Denier: 1450 de
Number of filaments: 1000 fil
Strength: 22 g/de
Elongation: 2.6%
Tensile modulus of elasticity: 820 g/de
Specific gravity: 1.45 b) Nylon 6,6:
Denier: 1,890 de
Number of filaments: 306 fil
Strength: 10.3 g/de
Elongation: 21.7%
Tensile modulus of elasticity: 50g/de
Specific gravity: 1.14

EXAMPLE 4

The reinforcing member was formed of a fiber-reinforced resin composite material containing two pieces of reinforcing fiber materials but without using the steel backing member on the inside. In this case, too, the PC steel rod could be prevented from protruding. Here, the PC steel rod was 32 mm in diameter and 6 meters long. The properties of the fiber-reinforced resin composite material and constitutions of the reinforcing fiber materials and starting yarns, were the same as those of the case of Example 3.

The foregoing examples have dealt with the case where the present invention was adapted to the ground cover or the side guard on the side surface of a long concrete molded article having a T-shape in cross section. Not being limited thereto only, however, the present invention can be also adapted to the cases where the reinforcing member is stuck to the surfaces having relatively large aspect ratios.

According to the present invention as will be obvious from the foregoing description, when the tensile member that is broken projects in the axial direction and comes into collision with the reinforcing member, the aramid fibers absorb the kinetic energy of the broken tensile member as they peel off the side surface of the prestressed concrete structure, since they have a relatively large tensile modulus and stretch little. On the other hand, the non-aramid fibers absorb the kinetic energy of the broken tensile member as they stretch instead of being peeled off, since they have a smaller tensile modulus than the aramid fibers and easily stretch.

According to the present invention, the energy absorbing mechanisms which are different in the two directions are compounded. As a result, the reinforcing member peels off the side surface of the prestressed concrete structure in a flat elliptic shape having a long diameter in the longitudinal direction of the side surface. Accordingly, the peeling of the reinforcing member does not reach the side surfaces of the prestressed concrete structure or, if described in further detail, does not reach the upper and lower edges of the side surface of the side guard. Therefore, performance for absorbing the kinetic energy of the broken tensile member does not decrease. Hence, the broken tensile member does not protrude by breaking through the reinforcing member and is very effectively prevented from protruding.

Besides, the reinforcing member is integrally formed by the fiber-reinforced resin composite material and is easy to handle, and can be easily attached to the prestressed concrete structure or to the side guard thereof on the site.

What is claimed is:

1. A prestressed concrete structure comprising:

an elongated concrete molded article having a pair of side surfaces opposed to each other;

a plurality of tensile members laterally extending through the concrete molded article to be secured at each end to the side surfaces of said concrete molded article in a tensioned state, and imparting a compressive load to said concrete molded article;

a pair of side guards arranged along both side surfaces of said concrete molded article so as to cover the ends of said tensile members; and reinforcing members arranged on side surfaces of said pair of side guards in order to prevent broken tensile members from protruding beyond the side surfaces of said pair of side guards by breaking through said side guards when said tensile members in the tensioned state are broken; wherein said reinforcing members stretch little in the longitudinal direction of the side surfaces of the side guards but easily stretch in the transverse direction on the side surfaces of said side guards, and when pushed from the inside by the ends of the tensile members that protrude as a result of breakage, the peeling of said reinforcing members easily spreads out in the longitudinal direction of the side surfaces of the side guards but spreads out little in the transverse direction on the side surfaces of the said side guards.

2. A prestressed concrete structure according to claim 1, wherein said reinforcing member includes warps that extend in the longitudinal direction on the side surfaces of said side guards, wefts that extend in the transverse direction, and a resin material for bonding said warps and said wefts, said warps having a tensile modulus of from 5000 to 18000 kgf/mm$^2$.

3. A prestressed concrete structure according to claim 2, wherein said warps have a tensile toughness of from 500 to 2200 kgf %/mm$^2$ and said wefts have a tensile toughness of from 300 to 3000 kgf %/mm$^2$.

4. A prestressed concrete structure according to claim 2, wherein said warps have a tensile strength of from 250 to 400 kgf/mm$^2$ and said wefts have a tensile strength of from 60 to 250 kgf/mm$^2$.

5. A prestressed concrete structure according to claim 3, wherein said warps contain aramid fibers, and said wefts contain non-aramid fibers.

6. A prestressed concrete structure according to claim 5, wherein said wefts are selected from the group consisting of polyester fibers, vinylon fibers and polyamide fibers.

7. A prestressed concrete structure according to claim 1, wherein said reinforcing member comprises a fiber-reinforced resin composite material using aramid fibers and non-aramid fibers, and includes a woven fabric having the following properties A and B:

property A: tensile modulus of from 150 to 15000 kgf/mm$^2$, property B: tensile toughness of from 400 to 4000 kgf %/mm$^2$.

8. A prestressed concrete structure according to claim 7, wherein said woven fabric contains the warps oriented in the longitudinal direction of said concrete molded article and the wefts oriented in the transverse direction, the warps using yarns containing not less than 50% by weight of aramid fibers and the wefts using the yarns containing non-aramid fibers.

9. A prestressed concrete structure according to claim 8, wherein said wefts are selected from the group consisting of polyester fibers, vinylon fibers and polyamide fibers.

10. A prestressed concrete structure according to claim 1, wherein said reinforcing member comprises a fiber-reinforced resin composite material using aramid fibers and non-aramid fibers, and includes a woven fabric having a tensile modulus of from 3000 to 15000 kgf/mm$^2$ in the direction of aramid fibers and a tensile modulus of from 150 to 3000 kgf/mm$^2$ in the direction of non-aramid fibers.

11. A prestressed concrete structure according to claim 10, wherein said woven fabric has a tensile toughness of from 500 to 2000 kgf %/mm$^2$ in the direction of aramid fibers, and a tensile toughness of from 400 to 4000 kgf %/mm$^2$ in the direction of non-aramid fibers.

12. A prestressed concrete structure according to claim 11, wherein said woven fabric has a tensile strength of from 200 to 350 kgf/mm$^2$ in the direction of aramid fibers, and a tensile strength of from 50 to 150 kgf/mm$^2$ in the direction of non-aramid fibers.

13. A prestressed concrete structure according to claim 10, wherein said woven fabric contains the warps oriented in the longitudinal direction of said concrete molded article and the wefts oriented in the transverse direction, the warps using the yarn containing not less than 50% by weight of aramid fibers and the wefts using the yarns containing non-aramid fibers.

14. A prestressed concrete structure according to claim 13, wherein said wefts are selected from the group consisting of polyester fibers, vinylon fibers and polyamide fibers.

15. A prestressed concrete structure according to claim 2, wherein said reinforcing member further includes a backing member arranged between the side surface of said side guard and the inner surface of said reinforcing member.

16. A prestressed concrete structure according to claim 15, wherein said backing member is a metal plate.

17. A fiber-reinforced resin composite material comprising a woven fabric of aramid fibers and non-aramid fibers, and a resin for bonding said woven fabric, said woven fabric having a tensile modulus of from 3000 to 15000 kgf/mm$^2$ in the direction of aramid fibers and a tensile modulus of from 150 to 3000 kgf/mm$^2$ in the direction of non-aramid fibers.

18. A fiber-reinforced resin composite material according to claim 17, wherein said woven fabric has a tensile toughness of from 500 to 2000 kgf %/mm$^2$ in the direction of aramid fibers, and a tensile toughness of from 400 to 4000 kgf %/mm$^2$ in the direction of non-aramid fibers.

19. A fiber-reinforced resin composite material according to claim 18, wherein said woven fabric has a tensile strength of from 200 to 350 kgf/mm$^2$ in the direction of aramid fibers, and a tensile strength of from 50 to 150 kgf/mm$^2$ in the direction of non-aramid fibers.

20. A fiber-reinforced resin composite material according to claim 17, wherein said woven fabric uses yarns containing not less than 50% by weight of aramid fibers as the warps and uses yarns containing non-aramid fibers as the wefts.

21. A fiber-reinforced resin composite material according to claim 20, wherein said wefts are selected from the group consisting of polyester fibers, vinylon fibers and polyamide fibers.

22. A sheet member containing a woven fabric of aramid fibers and non-aramid fibers, said woven fabric having a tensile modulus of from 3000 to 15000 kgf/mm$^2$ in the direction of aramid fibers and a tensile modulus of from 150 to 3000 kgf/mm$^2$ in the direction of non-aramid fibers.

23. A sheet member according to claim 22, wherein said woven fabric has a tensile toughness of from 500 to 2000 kgf %/mm$^2$ in the direction of aramid fibers, and a tensile toughness of from 400 to 4000 kgf %/mm$^2$ in the direction of non-aramid fibers.

24. A sheet member according to claim 23, wherein said woven fabric has a tensile strength of from 200 to 350 kgf/mm$^2$ in the direction of aramid fibers, and a tensile strength of from 50 to 150 kgf/mm$^2$ in the direction of non-aramid fibers.

25. A sheet member according to claim 22, wherein said woven fabric uses yarns containing not less than 50% by weight of aramid fibers as the warps and uses yarns containing non-aramid fibers as the wefts.

26. A sheet member according to claim 25, wherein said wefts are selected from the group consisting of polyester fibers, vinylon fibers and polyamide fibers.

27. A prestressed concrete structure according to claim 7, wherein said reinforcing member further includes a backing member arranged between the side surface of said side guard and the inner surface of said reinforcing member.

28. A prestressed concrete structure according to claim 27, wherein said backing member is a metal plate.

29. A prestressed concrete structure according to claim 10, wherein said reinforcing member further includes a backing member arranged between the side surface of said side guard and the inner surface of said reinforcing member.

30. A prestressed concrete structure according to claim 29, wherein said backing member is a metal plate.

31. A prestressed concrete structure comprising:

a plurality of elongated concrete molded articles arranged in parallel;

a plurality of tensile members laterally extending through said plurality of concrete molded articles arranged in parallel to be secured at each end to outer side surfaces of said concrete molded articles located on outermost sides of said concrete molded article in a tensioned state, and imparting a compressive load to all of said plurality of concrete molded articles;

a pair of side guards arranged along the outermost sides of the concrete molded articles so as to cover the ends of said tensile members; and reinforcing members arranged on side surfaces of said pair of side guards in order to prevent broken tensile members from protruding beyond the side surfaces of said pair of side guards breaking through said side guards when said tensile members in the tensioned state are broken; wherein said reinforcing members stretch little in the longitudinal direction of the side surfaces of the side guards but easily stretch in the transverse direction on the side surfaces of said side guards, and when pushed from the inside by the ends of the tensile members that protrude as a result of breakage, the peeling of said reinforcing members easily spreads out in the longitudinal direction of the side surfaces of the side guards but spreads out little in the transverse direction on the side surfaces of said side guards.

32. A prestressed concrete structure according to claim 31, wherein said reinforcing member includes warps that extend in the longitudinal direction on the side surfaces of said side guards, wefts that extend in the transverse direction, and a resin material for bonding said warps and said wefts, said warps having a tensile modulus of from 5000 to 18000 kgf/mm$^2$ and said wefts having a tensile modulus of from 300 to 4500 kgf/mm$^2$.

33. A prestressed concrete structure according to claim 32, wherein said warps have a tensile toughness of from 500 to 2200 kgf %/mm$^2$ and said wefts having a tensile modulus of from 300 to 4500 kgf/mm$^2$.

34. A prestressed concrete structure according to claim 32, wherein said warps have a tensile strength of from 250 to 400 kgf/mm$^2$ and said wefts have a tensile strength of from 60 to 250 kgf/mm$^2$.

35. A prestressed concrete structure according to claim 33, wherein said warps contain aramid fibers, and said wefts contain non-aramid fibers.

36. A prestressed concrete structure according to claim 35, wherein said wefts are selected from the group consisting of polyester fibers, vinylon fibers and polyamide fibers.

37. A prestressed concrete structure according to claim 31, wherein said reinforcing member comprises a fiber-reinforced resin composite material using aramid fibers and non-aramid fibers, and includes a woven fabric having the following properties A and B:

property A: tensile modulus of from 150 to 15000 kgf/mm$^2$, property B: tensile toughness of from 400 to 4000 kgf/mm$^2$.

38. A prestressed concrete structure according to claim 37, wherein said woven fabric contains the warps oriented in the longitudinal direction of said concrete molded article and the wefts oriented in the transverse direction, the warps using yarns containing not less than 50% by weight of aramid fibers and the wefts using yarns containing non-aramid fibers.

39. A prestressed concrete structure according to claim 38, wherein said wefts are selected from the group consisting of polyester fibers, vinylon fibers and polyamide fibers.

40. A prestressed concrete structure according to claim 31, wherein said reinforcing member comprises a fiber-reinforced resin composite material using aramid fibers and non-aramid fibers, and includes a woven fabric having a tensile modulus of from 3000 to 15000 kgf/mm$^2$ in the direction of aramid fibers and a tensile modulus of from 150 to 3000 kgf/mm$^2$ in the direction of non-aramid fibers.

41. A prestressed concrete structure according to claim 40, wherein said woven fabric has a tensile toughness of from 500 to 2000 kgf%mm$^2$ in the direction of aramid fibers, and a tensile toughness of from 400 to 4000 kgf %/mm$^2$ in the direction of non-aramid fibers.

42. A prestressed concrete structure according to claim 41, wherein said woven fabric has a tensile strength of from 200 to 350 kgf/mm$^2$ in the direction of aramid fibers, and a tensile strength of from 50 to 150 kgf/mm$^2$ in the direction of non-aramid fibers.

43. A prestressed concrete structure according to claim 40, wherein said woven fabric contains the warps oriented in the longitudinal direction of said concrete molded article and the wefts oriented in the transverse direction, the warps using yarns containing not less than 50% weight by aramid fibers and the wefts using yarns containing non-aramid fibers.

44. A prestressed concrete structure according to claim 43, wherein said wefts are selected from the group consisting of polyester fibers, vinylon fibers and polyamide fibers.

45. A prestressed concrete structure according to claim 41, wherein said woven fabric contains the warps oriented in the longitudinal direction of said concrete molded article and the wefts oriented in the transverse direction, the warps using yarns containing not less than 50% by weight of aramid fibers and the wefts using yarns containing non-aramid fibers.

46. A prestressed concrete structure according to claim 45, wherein said wefts are selected from the group consisting of polyester fibers, vinylon fibers and polyamide fibers.

47. A prestressed concrete structure according to claim 42, wherein said woven fabric contains the warps oriented in the longitudinal direction of said concrete molded article and the wefts oriented in the transverse direction, the warps using yarns containing not less than 50% by weight of aramid fibers and the wefts using yarns containing non-aramid fibers.

48. A prestressed concrete structure according to claim 47, wherein said wefts are selected from the group consisting of polyester fibers, vinylon fibers and polyamide fibers.

49. A prestressed concrete structure according to claim 31, wherein said reinforcing member further includes a backing member arranged between the side surface of said side guard and an inner surface of said reinforcing member.

50. A prestressed concrete structure according to claim 49, wherein said backing member is a metal plate.

* * * * *

UNITED STATES PATENT AND TRADEMARK OFFICE

CERTIFICATE OF CORRECTION

PATENT NO. : 6,250,030 B1 
DATED : June 26, 2001
INVENTOR(S) : Morihiko Sugimoto, Youji Yanagi and Akira Kidera It is certified that error appears in the above-identified patent and that said Letters Patent is hereby corrected as shown below:

Title page,
Item [30], Foreign Application Priority Data: insert -- Dec. 5, 1997 (JP) 9-350198 --

Signed and Sealed this

Third Day of September, 2002

*Attest:*

*Attesting Officer*

JAMES E. ROGAN
*Director of the United States Patent and Trademark Office*